US008322105B2

(12) United States Patent
Williams

(10) Patent No.: US 8,322,105 B2
(45) **Date of Patent: *Dec. 4, 2012**

(54) PULTRUDED UTILITY SUPPORT STRUCTURES

(75) Inventor: Donald S. Williams, Chicago, IL (US)

(73) Assignee: Duratel, LLC, Chicago, IL (US)

( * ) Notice: Subject to any disclaimer, the term of this patent is extended or adjusted under 35 U.S.C. 154(b) by 359 days.

This patent is subject to a terminal disclaimer.

(21) Appl. No.: 12/613,879

(22) Filed: Nov. 6, 2009

(65) Prior Publication Data

US 2010/0064630 A1 Mar. 18, 2010

Related U.S. Application Data

(63) Continuation-in-part of application No. 11/803,977, filed on May 16, 2007, now Pat. No. 8,024,908.

(60) Provisional application No. 60/801,856, filed on May 18, 2006.

(51) Int. Cl.
*E04C 3/30* (2006.01)
*E04H 12/02* (2006.01)

(52) U.S. Cl. ..... 52/651.01; 52/651.07; 52/852

(58) Field of Classification Search ..... 52/651.01, 52/651.07, 651.02, 831, 834, 836, 852
See application file for complete search history.

(56) References Cited

U.S. PATENT DOCUMENTS

| | | | | |
|---|---|---|---|---|
| 3,508,587 | A * | 4/1970 | Mauch | 138/119 |
| 3,574,104 | A * | 4/1971 | Medler | 428/222 |
| 3,987,593 | A | 10/1976 | Svensson | |
| 4,012,267 | A | 3/1977 | Klein | |
| 4,103,104 | A | 7/1978 | Spollen | |
| 4,142,343 | A | 3/1979 | Trafton | |
| 4,194,338 | A | 3/1980 | Trafton | |
| 4,314,434 | A * | 2/1982 | Meisberger | 52/651.02 |
| 4,516,069 | A | 5/1985 | Schmanski | |
| 4,738,058 | A | 4/1988 | Svensson | |
| 4,751,804 | A | 6/1988 | Cazaly | |
| 4,803,819 | A | 2/1989 | Kelsey | |
| 4,941,763 | A | 7/1990 | Euteneuer | |
| 5,091,036 | A * | 2/1992 | Taylor | 156/379.6 |
| 5,108,810 | A * | 4/1992 | Williams | 428/36.1 |

(Continued)

FOREIGN PATENT DOCUMENTS

CA 1 250 757 A1 3/1989

(Continued)

OTHER PUBLICATIONS

Pultusion Industry Council: Glossary of Terms; Copyright 2007—Pultrusion Industry Council http://www.cfa-hq.org/pic/products/glossary.htm.

(Continued)

*Primary Examiner* — Brian Glessner
*Assistant Examiner* — Joseph J Sadlon
(74) *Attorney, Agent, or Firm* — Gordon & Rees LLP

(57) ABSTRACT

Pultruded and extruded structures are presented. The pultruded and extruded structures are hollow structures, are used for structural distribution poles and transmission towers for electricity, may include lighting components and may include antenna wires in the hollow structures for telecommunications. The pultruded and extruded structures include combination pultruded-filament wound or "pull wound" structures. The pultruded and extruded structures are pultruded or extruded in pre-determined sizes and shapes, plural colors, are environmentally safe, aesthetic pleasing and resistant to damage from weather, animals, insects and resistant to corrosion.

19 Claims, 12 Drawing Sheets

U.S. PATENT DOCUMENTS

| | | | | | |
|---|---|---|---|---|---|
| 5,175,971 | A | | 1/1993 | McCombs | |
| 5,207,850 | A | | 5/1993 | Parekh | |
| 5,222,344 | A | | 6/1993 | Johnson | |
| 5,251,420 | A | | 10/1993 | Johnson | |
| 5,263,296 | A | | 11/1993 | Spera | |
| D344,351 | S | * | 2/1994 | Stagl | D25/122 |
| 5,379,566 | A | * | 1/1995 | Schworer | 52/632 |
| 5,457,288 | A | | 10/1995 | Olsson | |
| 5,465,929 | A | | 11/1995 | Dooley | |
| 5,476,627 | A | | 12/1995 | Black | |
| D370,273 | S | | 5/1996 | Stagl | |
| 5,513,477 | A | | 5/1996 | Farber | |
| 5,658,307 | A | | 8/1997 | Exconde | |
| 5,675,956 | A | * | 10/1997 | Nevin | 52/848 |
| 5,704,185 | A | | 1/1998 | Lindsay | |
| 5,716,686 | A | | 2/1998 | Black | |
| 5,718,669 | A | | 2/1998 | Marble | |
| 5,864,998 | A | * | 2/1999 | Loomer | 52/271 |
| 5,870,877 | A | | 2/1999 | Turner | |
| 5,890,333 | A | | 4/1999 | Boroviak | |
| 5,899,423 | A | | 5/1999 | Albertini | |
| 5,937,521 | A | | 8/1999 | March | |
| D415,574 | S | | 10/1999 | Shrira | |
| 5,979,119 | A | | 11/1999 | Trafton | |
| 6,047,514 | A | | 4/2000 | Verch | |
| 6,151,860 | A | * | 11/2000 | Reisdorff | 52/651.02 |
| 6,155,017 | A | | 12/2000 | Turner | |
| 6,174,483 | B1 | * | 1/2001 | Brown, Jr. | 264/285 |
| D441,877 | S | | 5/2001 | Fortier | |
| 6,357,196 | B1 | | 3/2002 | McCombs | |
| 6,367,215 | B1 | | 4/2002 | Laing | |
| 6,453,635 | B1 | | 9/2002 | Turner | |
| 6,484,647 | B2 | * | 11/2002 | Lininger Jr. et al. | 108/50.01 |
| 6,568,072 | B2 | | 5/2003 | Wilemon et al. | |
| 6,612,088 | B1 | * | 9/2003 | Damiano | 52/40 |
| 6,764,057 | B2 | | 7/2004 | Fanucci | |
| 6,808,334 | B2 | * | 10/2004 | Nicoletti | 403/170 |
| 6,812,276 | B2 | | 11/2004 | Yeager | |
| 6,834,469 | B2 | | 12/2004 | Fingerson | |
| 6,897,382 | B2 | | 5/2005 | Hager | |
| 6,955,024 | B2 | * | 10/2005 | Ashton | 52/843 |
| 6,993,802 | B1 | | 2/2006 | Hone | |
| 7,063,096 | B2 | | 6/2006 | Stoeckler | |
| 7,086,341 | B2 | * | 8/2006 | Peddicord | 108/180 |
| 7,116,282 | B2 | | 10/2006 | Trankina | |
| 7,127,865 | B2 | | 10/2006 | Douglas | |
| 7,200,973 | B2 | | 4/2007 | Tunis | |
| 7,228,672 | B2 | | 6/2007 | Hayes | |
| 7,578,245 | B2 | | 8/2009 | Loines | |
| 2001/0053820 | A1 | | 12/2001 | Yeager | |
| 2002/0037409 | A1 | | 3/2002 | Tunis | |
| 2002/0073915 | A1 | | 6/2002 | Howard | |
| 2003/0096123 | A1 | | 5/2003 | Yeager | |
| 2004/0026112 | A1 | | 2/2004 | Goldsworthy et al. | |
| 2004/0121137 | A1 | | 6/2004 | Tunis | |
| 2004/0134162 | A1 | | 7/2004 | Douglas | |
| 2005/0223673 | A1 | | 10/2005 | Cadwell | |
| 2006/0123725 | A1 | | 6/2006 | Godwin | |
| 2006/0150531 | A1 | | 7/2006 | Cann | |
| 2006/0201081 | A1 | | 9/2006 | Godwin | |
| 2006/0254167 | A1 | | 11/2006 | Antonic | |
| 2006/0289189 | A1 | | 12/2006 | Aisenbrey | |
| 2007/0013096 | A1 | | 1/2007 | Rekret | |
| 2007/0107370 | A1 | | 5/2007 | Douglas | |
| 2007/0209305 | A1 | | 9/2007 | Douglas | |
| 2007/0223993 | A1 | | 9/2007 | Peterson | |
| 2007/0252302 | A1 | | 11/2007 | Hager | |
| 2007/0266670 | A1 | | 11/2007 | Williams | |

FOREIGN PATENT DOCUMENTS

| | | | | |
|---|---|---|---|---|
| DE | 295 00 49 | U1 | | 8/1995 |
| FR | 2704891 | A1 | * | 11/1994 |
| GB | 2 425 296 | A | | 10/2006 |
| WO | WO 9201850 | A1 | * | 2/1992 |
| WO | WO 9315292 | A1 | * | 8/1993 |
| WO | WO 2006/050235 | A1 | | 1/2006 |

OTHER PUBLICATIONS

International Preliminary Report on Patentability PCT/US2007/011,781 dated Nov. 27, 2008.

* cited by examiner

PULTRUDED UTILITY SUPPORT STRUCTURES

CROSS REFERENCES TO RELATED APPLICATIONS

This U.S. Utility application is a Continuation-In-Part (CIP) of U.S. application Ser. No. 11/803,977, filed May 16, 2007, that claims priority to U.S. Provisional application 60/801,856 filed May 18, 2006, the contents of all of which are incorporated by reference.

FIELD OF INVENTION

This application relates to pultruded, extruded, filament wound or combination filament wound-pultruded structures. More specifically, it relates to pultruded and/or extruded and/or combination pultruded-filament wound or "pullwound" utility structures.

BACKGROUND OF THE INVENTION

Most utility poles used today made of wood. Distribution utility poles are divided into ten classes, from 1 to 10. The classes' definition specifies a minimum circumference that depends on the species of tree and the length of the pole. This circumference is measured 6 feet from the butt of the pole. There is also a minimum top circumference that is the same for all species and lengths.

For example, a class 1 pole has a minimum top circumference of 27 inches. If it is 25 feet long and cedar (most utility poles are cedar), the circumference measured 6 feet from the bottom must be at least 43.5 inches.

The higher the class number, the skinnier the pole. Pole lengths start at 16 feet and increase by 2-foot steps to 22 feet, then by fives from 25 feet to 90 feet. A 90-foot class 1 western red cedar pole weighs about 6,600 pounds. A 16-foot pole weighs only about 700.

All utility poles used are pressure treated to preserve the wooden utility poles from the weather, insects and other types of attacks and decay. Utility poles are treated with a number of toxic chemicals including pentachlorphenol, chromated copper arsenate, creosote, copper azole and others.

Pentachlorophenol (Penta) is widely-used wood preservative that is normally dissolved in a petroleum carrier. It is the most commonly used preservative system utilized by North American utilities.

Chromated Copper Arsenate (CCA) is water-borne treatment that offers a wide range of advantages for treated lumber, timber and poles; clean; odorless; paintable. For poles, its use is limited to southern yellow pine, *pinus sylvestris*, and western red cedar.

Creosote is an oil-based wood preservative blended from the distillation of coal tar and comprised of more than 200 major constituents. Used in industrial applications, such as railroad ties, piling (both salt water and fresh water), and for utility poles.

Copper Azole (CA-B) is a water-borne copper based wood preservative with an organic co-biocide (Tebuconazol). Similar in color, to CCA-C, odorless, clean, paintable or stainable. Copper Azole is approved by the American Wood Preservers Association for use on Western Red Cedar and Southern Yellow Pine utility poles.

There are several problems associated with wooden utility poles. One problem is that utility poles are heavy and bulky and hard to move and install. Another problem is that wooden utility poles are treated with chemicals that are harmful to the environment, and poisonous (e.g. arsenic, etc.) to humans and animals and have been shown in some instance to cause cancers. Another problem is that even with pressure treating the wood, wooden utility poles have to be replaced or retreated about every ten years. Another problem is that wooden utility poles are not aesthetically pleasing to look and are typically all a brown or black color.

There are also problems associated with transmission towers to which high voltage electrical lines are attached. An electricity pylon or transmission tower is a tall, usually steel lattice structure used to support overhead electricity conductors for electric power transmission. The structure is usually made from lynx triangles because if another shape is used it would slowly bend out of shape without bending the joints. The result would be a bent or broken pylon. For example if a rectangle is used it would bend into the shape of a parallelogram due to the associated forces.

One problem is that transmission towers are hard to design, expensive to build and hard to maintain. The transmissions towers are subject to large forces including those related to the transmission components such as wires and cable and environmental forces such as wind, rain, snow, ice, etc.

Another problem is that transmission towers often require additional support. Yet another problem is that transmission towers are difficult for maintenance workers and technicians to climb.

There have been attempts to solve some of these problems. For example, U.S. Pat. No. 7,159,370 that issued to Oliphant, et al. entitled "Modular fiberglass reinforced polymer structural pole system" teaches "This invention is a modular pole assembly comprised of corner pieces and panel members. Panel members are slidably engaged to the corner pieces and are retained in a direction normal to the engagement direction by a track in each slot that nests within a groove in each panel member. Corner pieces may include multiple slots along each side, allowing for multiple layers of panel members along each side, thereby increasing strength and allowing an insulative and structural fill material to be added between panel member layers. The height of the modular pole may be increased by inserting splicing posts between consecutive, adjacent corner members and inserting splicing pieces between co-planar adjacent panel members. The modular nature of the pole assembly provides for simple packaging and shipment of the various components and easy assembly at or near the installation location."

U.S. Pat. No. 6,453,635 that issued to Turner entitled "Composite utility poles and methods of manufacture" teaches "Composite utility pole structures and methods of manufacture using a pultrusion process. The poles may be N sided, with longitudinal pre-stressed rovings in each corner. The inner periphery of the poles may have flat regions centered between the outside corners, with the flat regions joined by circular arcs in the corner regions. Various pole structures and methods of manufacture are described, including curved poles and poles having walls that are tapered in thickness and structure."

U.S. Pat. No. 6,357,196 that issued to McCombs entitled "Pultruded utility pole" teaches "A hollow fiberglass utility pole includes a pair of segments that are a fiberglass sheet that has a semicircular cross-section. The segments have first and second longitudinal edges with male and female couplers respective shapes that have a complimentary relationship to each other for mechanical engagement thereof. The fiberglass pole is assembled by engaging the first longitudinal edge of one segment with the second longitudinal edge of the other segment at an installation site. The fiberglass pole may be used as a sheath to encase an existing wooden pole."

U.S. Pat. No. 5,311,713 that issued to Goodrich entitled Electric and telephone pole ground protector teaches "A device and method for protecting the end of a wooden utility pole set in the ground. A split cylindrical casing is provided which can be placed around the lower end of a wooden utility pole just before it is installed in the ground. The casing comprises an elongate, relatively thin cylindrical member having one closed end and being split into two sections connected together along the side thereof. The connection acts as a hinge. The edges of the casing where it is split are provided with a fastener, one part of the fastener being disposed along the edge of one part of the casing and another part of the fastener being disposed along the edge of the other part of the casing. When the cylindrical casing is closed, the edge of one part overlaps the edge of the other part so that the respective parts of the fasteners fit matingly together. Preferably, the fastener extends the entire length of the casing and entirely across the bottom end thereof. Preferably, the casing is made of high grade plastic."

U.S. Pat. No. 5,175,971 that issued to Maccomb entitled 'Utility power pole system" teaches "A utility power pole system comprises a pultruded hollow primary pole having an external hexogonal cross section and a number of longitudinal exterior grooves along its length. The hollow primary pole also has an internal hexogonal cross section rotated 30.degree. relative to the external hexagonal cross section. One or more pultruded hollow liners are provided which are also hexagonal in cross section and which may be internally or externally concentric with the primary pole. These liners vary in length to achieve an effective structural taper to the power pole system. The insertion of a tapered liner in the lower portion of the utility pole results in a utility pole having the effective load bearing capability of a tapered utility pole. By using a plurality of overlapping liners of varying lengths, an effective taper can be provided to the utility pole. The longitudinal grooves in the outer surface of the primary pole provide a means for climbing for a utility lineman and a means for attaching accessory attachment devices such as cross arms, stiffening members, conductor supports and for interconnection with other structural elements in a more extensive system. The rounded edges of each longitudinal groove are directed inwardly so as to retain devices in the groove which conform to the cross section of the groove. Cross arms attached to the utility pole may also employ similar longitudinal grooves to facilitate interconnection with existing utility hardware or other components."

U.S. Pat. No. 4,803,819 that issued to Kelsey entitled "Utility pole and attachments formed by pultrusion of dielectric insulating plastic, such as glass fiber reinforced resin" teaches "a utility pole and attachments formed by pultrusion of dielectric insulating plastic, such as glass fiber reinforced resin."

However, none of these solutions overcome all of the problems with utility poles and utility structures. Thus, it would be desirable to solve some of the problems associated with utility poles and utility structures such as transmission towers.

SUMMARY OF THE INVENTION

In accordance with preferred embodiments of the invention, some of the problems associated with utility poles and utility structures such as distribution monopoles, H-frame structures and transmission towers are overcome.

The pultruded and extruded structures are hollow structures, are used for structural distribution poles and transmission towers for electricity, may include lighting components and may include antenna wires in the hollow structures for telecommunications. The pultruded and extruded structures include combination pultruded-filament wound or "pull wound" structures. The pultruded and extruded structures are pultruded or extruded in pre-determined sizes and shapes, plural colors, are environmentally safe, aesthetic pleasing and resistant to damage from weather, animals, insects and resistant to corrosion.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF THE INVENTION

Extruded Utility Structures

"Extrusion" is a manufacturing process where a material is pushed and/or drawn through a die to create long objects of a fixed cross-section. Hollow sections are usually extruded by placing a pin or mandrel in the die. Extrusion may be continuous (e.g., producing indefinitely long material) or semi-continuous (e.g., repeatedly producing many shorter pieces). Some extruded materials are hot drawn and others may be cold drawn.

The feedstock may be forced through the die by various methods: by an auger, which can be single or twin screw, powered by an electric motor; by a ram, driven by hydraulic pressure, oil pressure or in other specialized processes such as rollers inside a perforated drum for the production of many simultaneous streams of material.

Plastic extrusion commonly uses plastic chips, which are heated and extruded in the liquid state, then cooled and solidified as it passes through the die. In some cases (such as fiber reinforced tubes) the extrudate is pulled through a very long die, in a process called "pultrusion."

Figure 1:
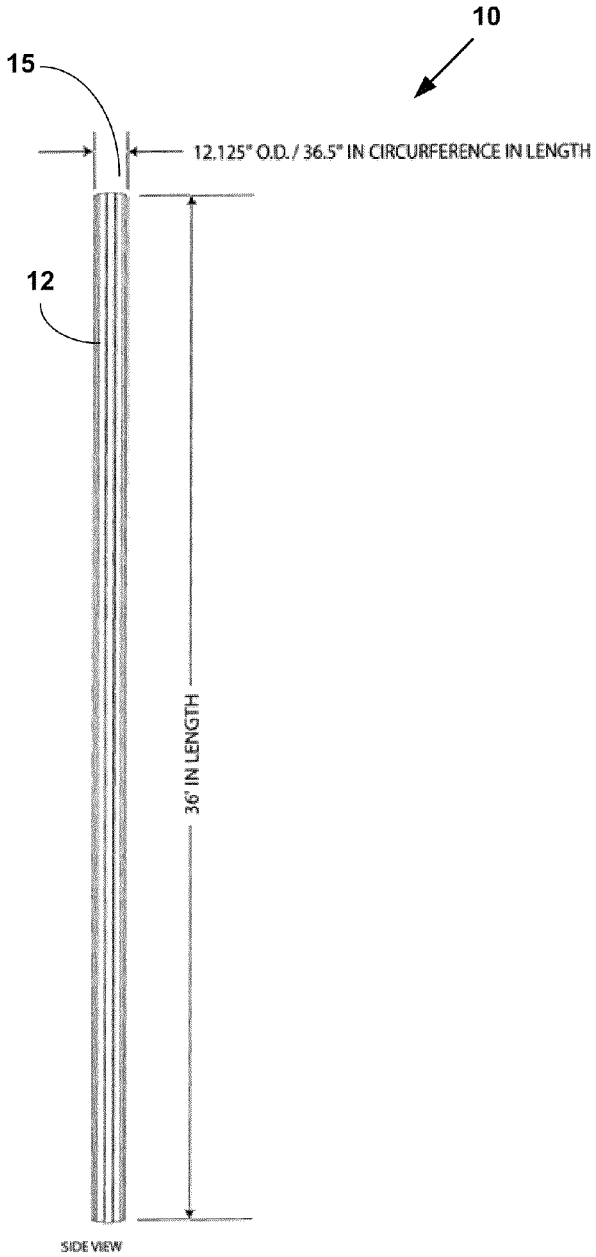
FIG. 1 is a block diagram illustrating a side view of an exemplary extruded hollow structure.

FIG. 1 is a block diagram illustrating a side view 10 of an exemplary pultruded, extruded or combination pultruded-filament wound hollow structure 12.

In one embodiment, the extruded structure 12 comprises extruded plastic materials including, but not limited to, Polyvinyl Chloride (PVC), Acrylonitrile Butadiene Styrene (ABS), High Impact Polypropylene (HIP), Polypropylene, High-Density Polyethylene (HDPE), Polycarbonate, Polyethylene Terephthalate Glycol (PETG), Nylon, Fiber reinforced Polypropylene, Fiber Reinforced Plystyrene and other types of plastics. In another embodiment, the extruded structure 12 comprises composite materials. In another embodiment, the extruded structure 12 comprises recycled plastic materials.

The extruded structure 12 is extruded in plural different colors (e.g., red, green, yellow, blue, brown, etc.) and is aesthetically pleasing. The plural different colors may blend in with a natural environmental setting or a pre-determined design scheme. For example, a new subdivision may include only blue extruded utility poles.

In one exemplary embodiment, the extruded structure 12 is an extruded plastic utility pole 12 of extruded to a length of at least 36' in length. The exemplary extruded structure 12 has an outside at least 12.125" and a 36.5" circumference. However, the present invention is not limited to the dimensions described and other extruded utility poles 12 of other lengths and dimensions can also be used to practice the invention.

In one embodiment, the extruded structure 12 includes a pre-determined length (e.g., 8 feet, 16 feet, 24 feet, 36 feet, 40 feet, 65 feet, 80 feet, etc.). However, the present invention is not limited to these lengths and other lengths can be used to practice the invention.

In one embodiment, a 36' length of the extruded structure 12 weighs about 100 pounds. It is estimated that a 36' length of the extruded structure 12 has a tensile strength of about 8,500 pounds per square inch (PSI).

It is estimated that an extruded structure 12 would have a lifetime of over 100 years and be safe to the environment, humans and animals. The extruded structure 12 is resistance to damage from the weather, animals, insects and is corrosion resistant.

Figure 2:
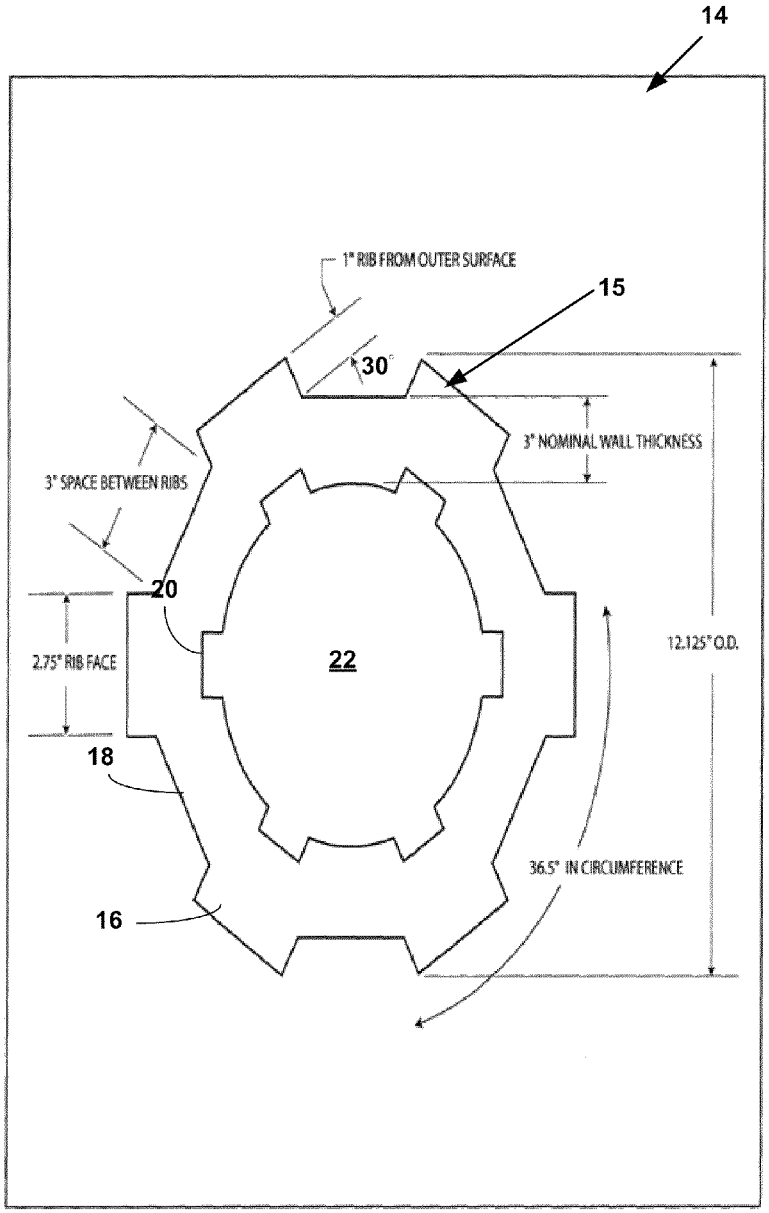
FIG. 2 is a block diagram illustrating a top view of an exemplary extruded hollow structure.

FIG. 2 is a block diagram illustrating a top view 14 of an exemplary extruded structure 15. In one exemplary embodiment, the exemplary extruded structure 12 includes plural ribbed faces. The plural rib faces 16 are connected with plural angular faces 18. An inner surface of the plural rib faces 16 includes plural intrusions 20. The plural intrusions 20 are in alignment with the plural ribbed faces 16.

In one embodiment the plural intrusions 20 are used a channel to hold plural different sets of wires such as communications wires or antenna wires and wires for lighting structures.

FIG. 2 is illustrated with an exemplary embodiment. However, the present invention is not limited to such an embodiment and other embodiments can also embodiments can also be used to practice the invention.

In such an embodiment, exemplary extruded structure 12 includes plural flat rib faces 16. In one embodiment, the plural flat rib faces include a width of about 2.75". The plural flat rib faces 16 comprise a rib of about 1" from the outer surface of the extruded structure 12. The plural flat rib faces 16 are connected with plural angular faces 18. In one embodiment, the plural angular faces 18 include an angle of about 30 degrees and a flat surface of about 3" in width. The extruded utility pole includes a circumference of about 36.5" and an outside diameter of about 12.125". An inner surface of the plural flat rib faces 16 includes plural flat intrusions 20. The plural flat intrusions 20 can be used a channel to hold plural different sets of wires such as communications wires or antenna wires and for lighting structures.

However, the present invention is not limited to the shapes and dimensions described and other extruded structures 12 of other shapes and dimensions can also be used to practice the invention.

In one embodiment, the extruded structure 12 includes one or more receptacles are pre-determined heights in the plural flat rib faces 16. In such an embodiment, the one or more receptacles are used for adding utility components such utility boxes, etc. The one or more receptacles may include pre-determined features such as a screw pattern or other pattern for inserted a screw or other attachment means.

In another embodiment, the plural flat rib faces 16 include plastic, nylon, composite materials or other types of filaments to add additional strength to the extruded structure 12.

In another embodiment, the plural flat rib faces 16 include integral copper wires that allow the extruded structure 12 to be used an antenna for wireless or other types of communications and for lighting structures. In another embodiment, the integral copper wires are embedded into other surfaces of extruded structure 12.

FIG. 2 illustrates an extruded structure 12 with a hollow core 22. In such an embodiment, communications wires (e.g., fiber optic, copper, coaxial cable, etc.) or antenna wires or wires for lighting structures can be run through the hollow core (as well as the plural flat intrusions 20) to connect to other communications wires buried underground in dirt or sub-terrain pipes or tunnels. This avoids connecting unsightly communications wires and lighting wires between two or more extruded structure 12 and protects the communications wires or antenna wires or lighting wires from damage by the weather and animals.

FIG. 2 illustrates an extruded structure 12 with a hollow core. However, the present invention is not limited to this embodiment and the extruded structure 12 can be extruded as solid piece of material. In such an embodiment, the weight of the extruded structure 12 would be more than 100 pounds and have a different tensile strength.

In one embodiment, the extruded structure 12 includes a fiber or webbing re-enforced cylindrical structure comprising a utility pole, a lighting pole, a structural support, an architectural design element (interior or exterior), a marine dock element or a fencing element.

In one embodiment, the extruded structure 12 includes additional fiberglass, plastic, ester, polyester, nylon, composite materials or other types of filaments or webbing to add additional strength to the extruded structure 12. The filaments or webbing are applied internally or externally to the extruded structure 12.

The structure of the external and internal surfaces in an alternating and repeating pattern of the extruded structure 12 provides additional tensile strength to the structure. In addition, the angular lines of the structure are aesthetically pleasing.

In addition, the shape of the extruded structure 12 provides an optimal resistance, or near optimal resistance to wind shear forces.

In another embodiment, the extruded structure 12 is also pultruded in a same shape and size.

Pultruded Utility Structures

As is known in the art, "pultrusion" is a manufacturing process for producing continuous lengths of materials. Pultrusion raw materials include a liquid resin mixture (e.g., containing resin, fillers and specialized additives) and reinforcing fibers (e.g., fiberglass, composite materials, etc.). The process involves pulling these raw materials (rather than pushing as is the case in extrusion) through a heated steel forming die using a continuous pulling device. The reinforcement materials are in continuous forms such as rolls of fiberglass mat or doffs of fiberglass roving. As the reinforcements are saturated with the resin mixture in the resin impregnator and pulled through the die, the gelation (or hardening) of the resin is initiated by the heat from the die and a rigid, cured profile is formed that corresponds to the shape of the die.

There are also protruded laminates. Most pultruded laminates are formed using rovings aligned down the major axis of the part. Various continuous strand mats, fabrics (e.g., braided, woven and knitted), and texturized or bulked rovings are used to obtain strength in the cross axis or transverse direction.

The pultrusion process is normally continuous and highly automated. Reinforcement materials, such as roving, mat or fabrics, are positioned in a specific location using preforming shapers or guides to form a pultrusion. The reinforcements are drawn through a resin bath where the material is thoroughly coated or impregnated with a liquid thermosetting resin. The resin-saturated reinforcements enter a heated metal pultrusion die. The dimensions and shape of the die define the finished part being fabricated. Inside the metal die, heat is transferred initiated by precise temperature control to the reinforcements and liquid resin. The heat energy activates the curing or polymerization of the thermoset resin changing it from a liquid to a solid. The solid laminate emerges from the pultrusion die to the exact shape of the die cavity. The laminate solidifies when cooled and it is continuously pulled through the pultrusion machine and cut to the desired length. The process is driven by a system of caterpillar or tandem pullers located between the die exit and the cut-off mechanism.

In one embodiment the pultrusion resins include bisphenol-a epichlorohydrin-based vinyl esters. In another embodiment, the resins include polyesters including isophthalic, orthophthalic, propylene-maleate, fire resistant, and high cross-link density. However, the present invention is not limited to these resins and other resins can be used to practice the invention.

In one embodiment, the pultrusions include re-enforcing fibers comprising, fiberglass fibers, composite fibers, etc. However, the present invention is not limited to these resins and other resins can be used to practice the invention.

One resin used in fiberglass pultrusions is a thermoset resin. The resin used in Polyvinyl Chloride (PVC) pultrusions are typical thermoplastic resins. In the pultrusion process, under heat and pressure, the thermoset resins and re-enforcing fibers form a new inert material that is impervious to temperature. Pultruded fiberglass physical properties do not change through the full temperature cycle up to temperatures of about 200 degrees Fahrenheit (° F.). In direct contrast, PVC resins typically become unstable at temperatures greater than 155° F.

Pultrusions, include but are not limited to, structures comprising: (1) HIGH STRENGTH—typically stronger than structural steel on a pound-for-pound basis; (2) LIGHTWEIGHT—Pultrusions are 20-25% the weight of steel and 70% the weight of aluminum. Pultruded products are easily transported, handled and lifted into place; (3) CORROSION/ROT RESISTANT—Pultruded products will not rot and are impervious to a broad range of corrosive elements; (4) NON-CONDUCTIVE—fiberglass reinforced pultrusions have low thermal conductivity and are electrically non-conductive; (5) ELECTRO-MAGNETIC TRANSPARENT—Pultruded products are transparent to radio waves, microwaves and other electromagnetic frequencies; (6) DIMENSIONAL STABILE—The coefficient of thermal expansion of pultruded products is slightly less than steel and significantly less than aluminum; (7) LOW TEMPERATURE CAPABLE—FiberGlass fiber reinforced pultrusions exhibit excellent mechanical properties at very low temperatures, even −70° F. Tensile strength and impact strengths are greater at −70° F. than at +80° F.; (8) AESTHETICALLY PLEASING—Pultruded profiles are pigmented throughout the thickness of the part and can be made to virtually any desired custom color. Special surfacing veils are also available to create special surface appearances such as wood grain, marble, granite, etc.; and (9) COST EFFECTIVE—pultruded products are typically cheaper than those made of metals, wood, etc. and other materials.

In another embodiment the pultruded or extruded utility structures described above and illustrated in FIGS. 1 and 2 are pultruded. In such embodiments a pultrusion die is created based on the desired design shape illustrated FIG. 2.

Figure 3:
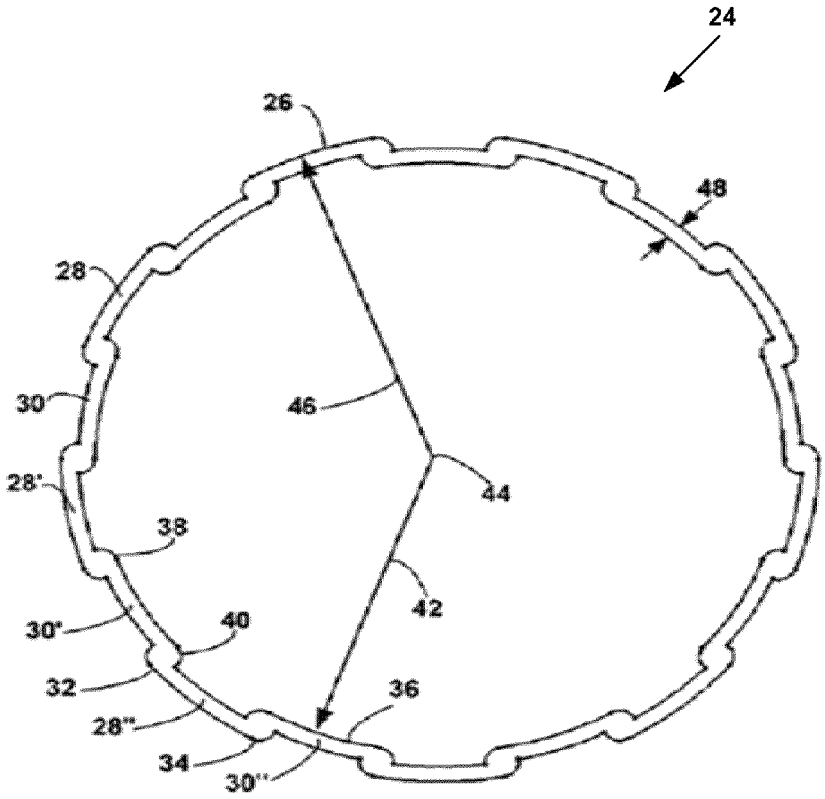
FIG. 3 illustrates a cross-section of a pultruded hollow structure.

FIG. 3 illustrates a cross-section of a pultruded hollow cylindrical structure 24. In one embodiment the pultruded hollow cylindrical structure includes an external surface 26 including plural protruding components 28 connected to plural intruding components 30. A protruding component 28' includes two curved components 32, 34 for connecting the protruding component 28' to two other intruding components 30' and 30".

The pultruded hollow cylindrical structure 24 further includes an internal surface 36 including plural intruding components 30 connected to the plural protruding components 28. An intruding component 30' includes two curved components 38, 40, to connect the intruding component 30' to two other protruding components 28' and 28"

The curved components 32, 34, 38, 40 include a pre-determined radius with two outer radius portions on an protruding component 28' and two inner radius portions on an intruding component 30'.

The pultruded hollow cylindrical structure includes a pre-determined inner radius 42 from a center point 44 to an inner portion of the internal surface 36 and includes a pre-determined outer radius 46 from the center point 44 to an outer portion of the external surface 26. The difference between the pre-determined inner radius and pre-determined outer radius determines a thickness 48 of the pultruded hollow cylindrical structure 24.

The pultruded hollow cylindrical structure 24 includes a pre-determined length and a pre-determined color.

In one embodiment, a pultrusion die is created with the design shape and dimensions illustrated in FIG. 3. However, the present invention is not limited to such an embodiment and other embodiments with other dimensions can be used to practice the invention.

The structure of the external and internal surfaces in an alternating and repeating pattern of the pultruded hollow cylindrical structure 14, 24 provide additional tensile strength to the structure. In addition, the curved lines of the pultruded hollow cylindrical structure 14, 24 are aesthetically pleasing. In addition, the shape of the pultruded hollow cylindrical structure 14, 24 provide an optimal resistance, or near optimal resistance to wind shear forces.

FIG. 3 illustrates a pultruded hollow cylindrical structure 24 with a hollow core. However, the present invention is not limited to this embodiment and the pultruded structure 24 can be pultruded as solid piece of material by changing the pultrusion die.

Figure 4:
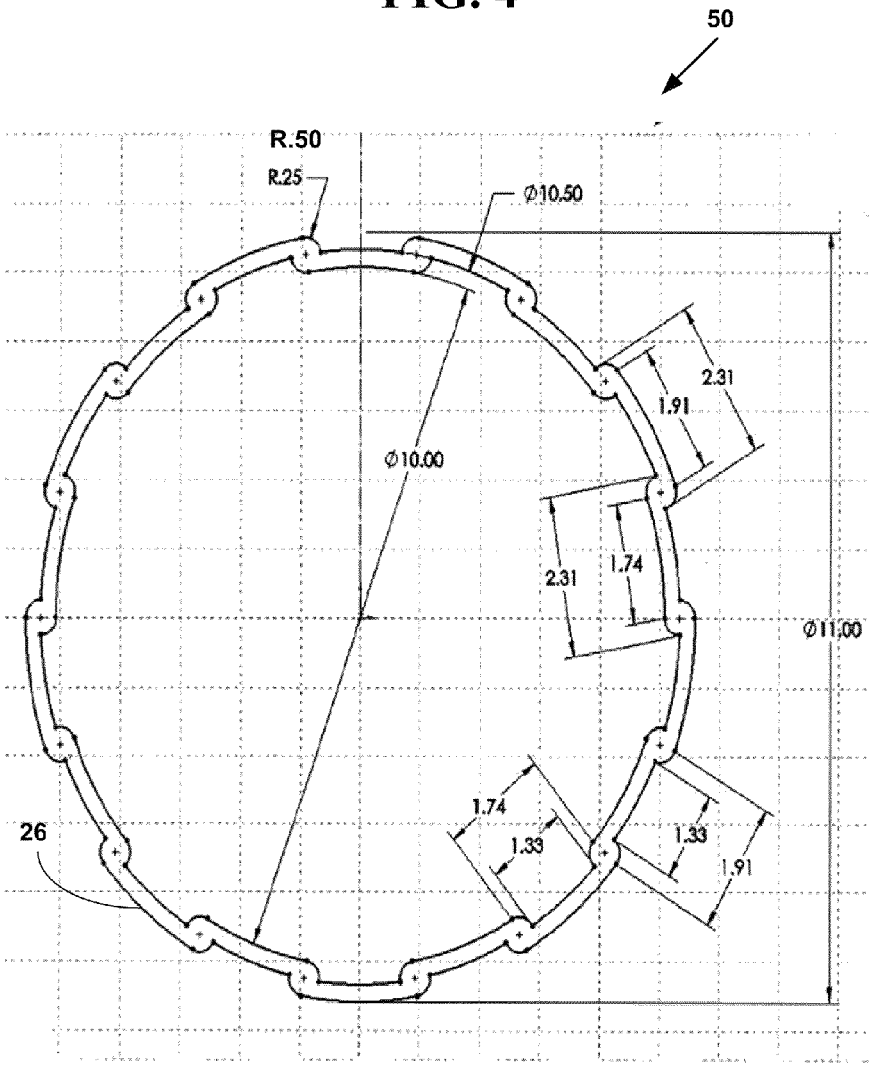
FIG. 4 illustrates a cross-section of an exemplary pultruded hollow structure.

FIG. 4 illustrates a cross-section of an exemplary pultruded hollow structure 50.

Figure 5:
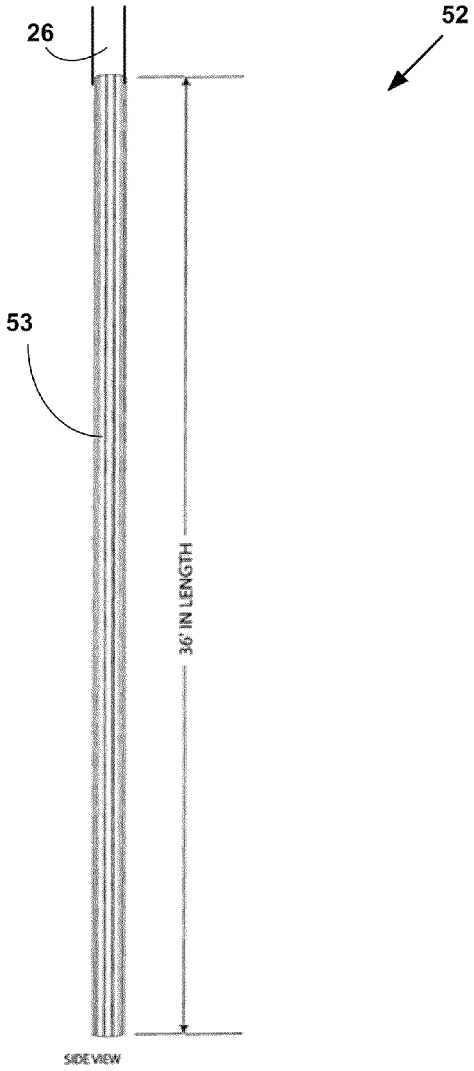
FIG. 5 illustrates a block diagram of a side view of an exemplary pultruded hollow structure.

FIG. 5 illustrates a block diagram 52 of a side view of an exemplary pultruded hollow structure 53. In this figure the pultruded hollow cylindrical structure 53 includes the pultruded hollow cylindrical structure 24 with a hollow core of FIG. 3.

The pultruded hollow cylindrical structure 53 is illustrated with an exemplary embodiment as is illustrated in FIG. 4. However, the present invention is not limited to this embodiment and other embodiments can also be used to practice the invention.

In one embodiment, the pultruded hollow cylindrical structure 53 includes a cylindrical structure comprising a utility pole, a lighting pole, a structural support, an architectural design element (interior or exterior), a marine dock element or a fencing element, etc.

The pultruded hollow cylindrical structures 14, 24 include a pre-determined length (e.g., 8 feet, 16 feet, 24 feet, 36 feet, 40 feet, 65 feet etc.). However, the present invention is not limited to these lengths and other lengths can be used to practice the invention.

The pultruded hollow cylindrical structures 14, 24 includes plural different colors (e.g., red, green, yellow, blue, brown, etc.) and is aesthetically pleasing. The plural different colors may blend in with a natural environmental setting or a pre-determined design scheme. For example, a new subdivision may include only blue utility poles, while a boat dock may include only high visibility orange decking comprising the pultruded hollow cylindrical structures 14, 24. However, the present invention is not limited to these colors and other colors can be used to practice the invention.

The pultruded hollow cylindrical structure 24 includes a repeating pattern of alternating protruding and intruding components.

In one embodiment, the pultruded hollow cylindrical structure 24 includes one or more receptacles at pre-determined heights. In such an embodiment, the one or more receptacles are used for adding utility components such utility boxes, etc. The one or more receptacles may include pre-determined features such as a screw pattern or other pattern for inserted a screw or other attachment means.

In one embodiment, the plural protruding components and plural intruding components include additional fiberglass, plastic, ester, polyester, nylon, composite materials or other types of filaments or webbing to add additional strength to the pultruded hollow cylindrical structure 24. The filaments or webbing are applied internally or externally to the pultruded hollow cylindrical structure 24.

In another embodiment, the pultruded hollow cylindrical structure 24 includes integral copper wires in or more surfaces that allow the structure to be used an antenna for wireless or other types of communications.

Various exemplary and specific measurements are described herein. However, the present invention is not limited to these exemplary and specific measurements. In addition, the extruded and pultruded structures described herein can be made with specific measurements for actual products such as 2×4's, structural beams, fencing, wooden telephone poles, etc. In such embodiments, the extruded or pultruded structures may be thicker then necessary and may include the shapes of the actual products instead of the shapes describe herein.

In another embodiment, the pultruded structure 26 is also extruded in a same shape and size.

In one embodiment, extruded structure 15 and/or pultruded structure 26 are produced with an overwrapping transverse winding process called "pullwinding." The pullwinding process combines continuous filament winding with a pultrusion manufacturing process to produce a pultruded pullwound hollow cylindrical structure with the shape of hollow cylindrical structures 14 and/or 50.

This "pullwinding" process incorporates plural longitudinal reinforcement fibers with plural helical-wound (e.g., hoop, etc.) layers, providing maximum torsional properties and hoop strength. A self-contained inline winding unit is used with a pultrusion machine for feeding angled fibers between layers of unidirectional fibers before curing in a pultrusion die. The plural longitudinal re-enforcement fibers are used for axial and bending resistance while the plural helical-wound fibers are used for hoop tension and compression resistance. The pullwinding equipment is comprised of twin winding heads which revolve in opposite directions over a spindle. However, the present invention is not limited to such an embodiment and other embodiments can also be used to practice the invention. The present invention can be practiced without the pullwound components.

Utility Line Support Structures

In another embodiment, the extruded or pultruded structures include a utility line support structure.

Figure 6:
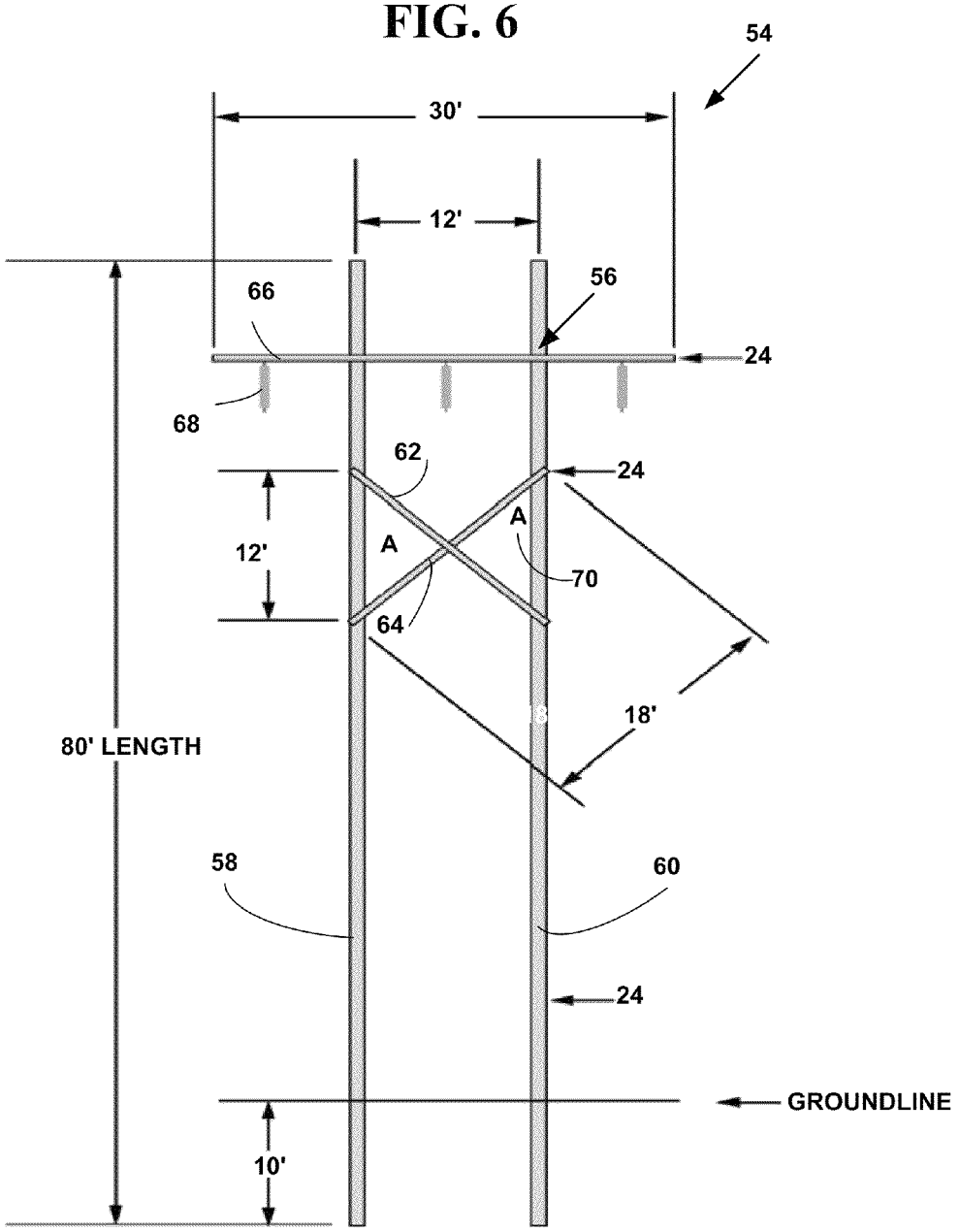
FIG. 6 is a block diagram illustrating an exemplary distribution or transmission support structure.

FIG. 6 is a block diagram 54 illustrating an exemplary utility line support structure 56. The utility line support structure is easier to design, install and maintain than transmission towers designed and built from steel, wood and other materials. No special triangular or trapezoidal design is necessary with structure 56 as is required for transmission towers made from steel or other materials.

The exemplary utility line support structure 56 is composed of a first and a second hollow cylindrical structures comprising two leg components 58, 60 having two legs extending upward in an H-frame shape. In one embodiment, the first leg component 58 and the second leg component 60 include either extruded structures (FIGS. 1-2) and/or pultruded structures (FIGS. 3-5) or any combination thereof. However, the present invention is not limited to these structures and other structures can also be used to practice the invention The utility line support structure 56 includes a pair of composite cross braces 62, 64 that extend between and are connected at their ends between two leg sections 58, 60 and include a support structure in the shape of the letter "X". However, the present invention is not limited to this attachment shape and other attachment shapes can also be used to practice the invention.

In one embodiment, a first end and a second end of the first cross-brace 62 and the second cross-brace 64 are connected at a pre-determined angle 70 between the first leg 58 and the second leg 60. In one embodiment, a length between attaching the cross braces 62, 64 to the two leg sections 58, 60 at the pre-determined angle 70 is at a length of at least 12 feet. However, the present invention is not limited to this attachment length and other lengths can also be used to practice the invention.

In one exemplary embodiment, the first cross-brace 62 and second cross brace 64 include a length of 18 feet. However, the present invention is not limited to these lengths and other lengths can also be used to practice the invention.

In one embodiment, the two cross braces 62, 64 include either extruded structures 10 (FIGS. 1-2) and/or pultruded structures 52 (FIGS. 3-5) or any combination thereof. However, the present invention is not limited to these structures and other structures can also be used to practice the invention.

In another specific exemplary embodiment, the first cross-brace 62 and the second cross-brace 64 include an extruded and/or pultruded hollow cylindrical structure (FIGS. 1-5) with and outer diameter of about 4.125", and inner diameter of about 2.25", a thickness of about 0.25" to about 0.50" and a length of about 18 feet. However, the present invention is not limited to these sizes and measurements and other sizes and measurements can also be used to practice the invention. For example the structure 56 may include hollow cylindrical structures for all components what are the same size and shape.

In one embodiment, the cross braces 62, 64 attach to the leg sections 58, 60 by a through bolt and washer. A through bolt and washer join the cross braces 62, 64 at their intersection. However, the present invention is not limited to such an attachment mechanisms and other attachment mechanisms can also be used to practice the invention.

In one embodiment, the two leg sections 58, 60, comprise the hollow pultruded structures 52 illustrated in FIGS. 3-5 but with an overall length of 80 feet. In another embodiment, the two leg sections 58, 60 comprise the hollow extruded structures 10 illustrated in FIGS. 1-2 but with an overall length of 80 feet. However, the present invention is not limited to these structures and other structures can also be used to practice the invention.

In one embodiment, the two leg sections 58, 60 are buried below ground level with a depth of at least 10 feet. However, the present is not limited to such a burial depth and other burial depths and lengths can be used to practice the invention.

The structure 56 is directly embedded into the ground with or without the use of a reinforced concrete footing, depending on soil content, environment, and required load for the structure. The different components of the structure 56 can be all a same color, all in varying colors, or various combinations thereof of color for aesthetics or identifying specific needs.

At the top of the leg sections 58, 60 a cross arm component 66 for supporting electric transmission components 68, electrical sub-transmission components, electrical distribution lines and other loads is connected at attachment points to the first and second leg component 58, 60. The cross arm component 66 horizontally extends past the first and second leg components at a pre-determined distance.

In one embodiment, the cross arm component 66 includes either hollow extruded structures 10 (FIGS. 1-2) and/or pultruded structures 52 (FIGS. 3-5) or any combination thereof. However, the present invention is not limited to these structures and other structures can also be used to practice the invention.

In one specific exemplary embodiment, the cross arm component 66 includes an extruded and/or pultruded hollow cylindrical structure 10, 52 (FIGS. 1-5) with and outer diameter of about 6", and inner diameter of about 4" and a thickness of 0.25" to about 0.50" and a length of about 30 feet. However, the present invention is not limited to these sizes and measurements and other sizes and measurements can also be used to practice the invention.

Figure 7:
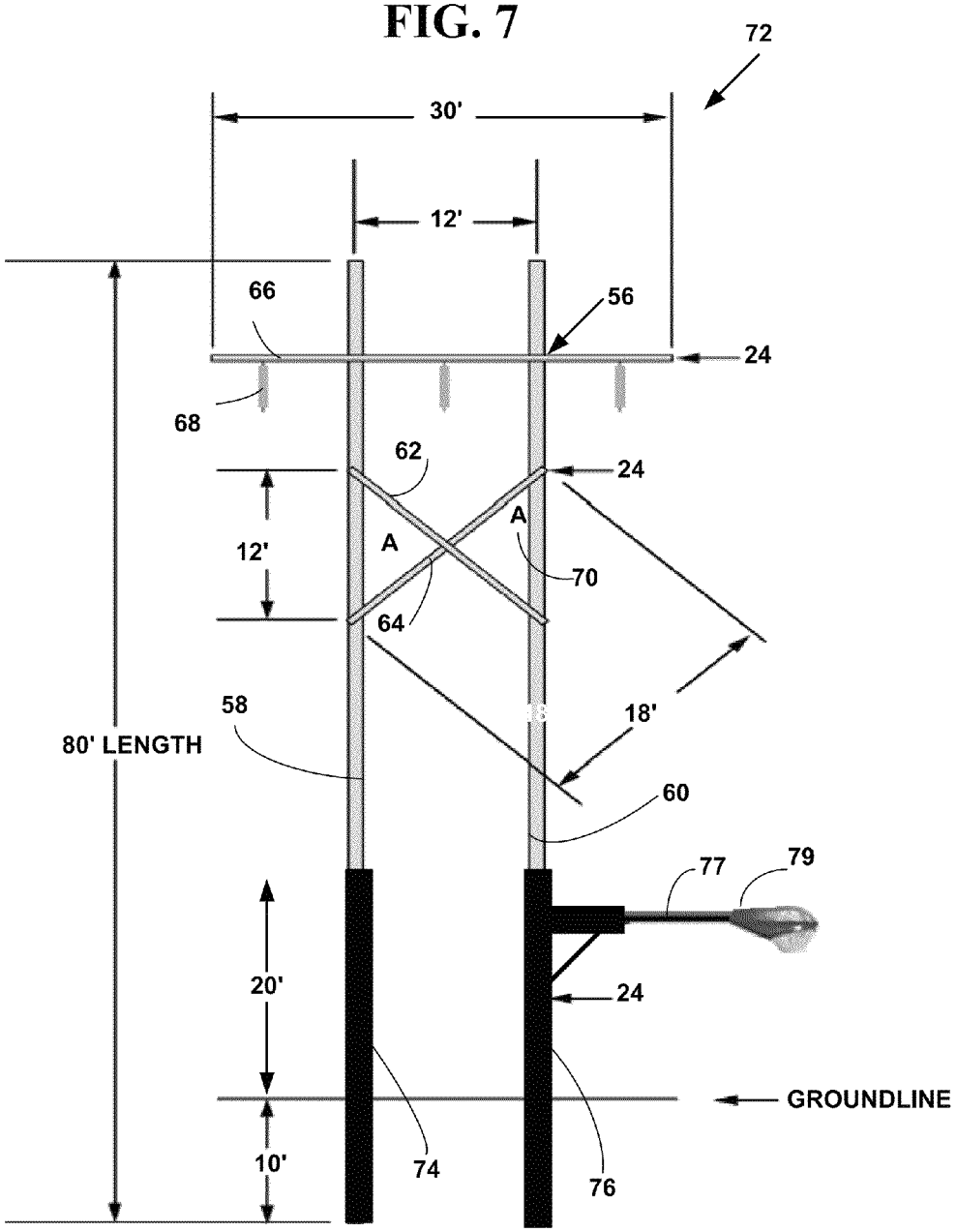
FIG. 7 is a block diagram illustrating another exemplary distribution or transmission support structure.

FIG. 7 is a block diagram 72 illustrating another exemplary utility line support structure 56.

A third leg component 74 and a fourth leg component 76 each comprising the hollow cylindrical structure at a fourth pre-determined length are included as components of structure 56. The pre-determined radius with the two outer radius portions on the protruding component and two inner radius portions are larger than the two outer radius portions on the protruding component and two inner radius portions used for the first leg component and the second leg component. A thickness of the hollow cylindrical structure for the third leg component 74 and the fourth leg component 76 is greater than the thickness of the hollow cylindrical component used for the first leg 58 component and the second leg component 60. The third leg component 74 and the fourth leg component 76 are securely embedded into a surface composite utility line support structure. The first leg component 58 since it is smaller in radius is placed within the third leg component 74 and the second leg component 60 since it is smaller in radius is placed in the fourth leg component 75, thereby providing additional strength for the composite utility line support structure 56. The shape of the leg components also provides inter-locking, thereby providing additional structure to the structure that would not have been obtained if the leg components were a smooth circular shape.

In one example, FIG. 2 illustrates an extruded hollow cylindrical structure 16 with an outer diameter of about 12.125", and inner diameter of about 9.125" and about a 3" thickness. In one exemplary embodiment, the third leg component 72 and the fourth leg component 74 include an inner diameter of about 10.125" and an outer radius of about 13.125" and thickness of about 3.5". However, the present invention is not limited to these measurements and other measurements can also be used to practice the invention.

In another example, FIG. 4 illustrates a pultruded hollow cylindrical component 50 with an inner diameter of about 10" and an outer diameter of about 11" and a thickness of about 0.25". In one exemplary embodiment, the third leg component 72 and the fourth leg component 74 include an diameter of about 12" and an outer diameter of about 13" and thickness of about 0.5". However, the present invention is not limited to this measurements and other measurements can also be used to practice the invention.

In one exemplary embodiment, the third leg component 72 and the fourth leg component 74 include a pre-determined length of 40 feet for burial at a 10 foot depth, with 30 feet exposed above a ground line for engaging the first and second leg components 58, 60. In one embodiment, the third leg component 72 and the fourth leg component 74 are equal in length. In another embodiment, the third leg component 72 and the fourth leg component 74 are not-equal in length and are used in areas where the terrain is sloped or un-even or includes natural barriers against insertion such as rock outcrops, rivers, streams, etc. However, the present invention is not limited to these lengths and measurements and other lengths measurements can also be used to practice the invention.

In another embodiment, the first, second, third and fourth leg components 58, 60, 72 and 74 include various combinations of the extruded and pultruded hollow cylindrical structures 10, 50, thereby providing different types of inter-locking between the hollow cylindrical structures with differences in additional strength.

In another embodiment, the structure 56 further includes a lighting support component 77. The lighting support component 77 includes plural hollow cylindrical structures. FIG. 7 illustrates two hollow cylindrical structure 10, 50 for simplicity. The light component 77 also includes a lighting bulb component 79. Wires to connect the lighting bulb component 79 are feed through the plural components of the lighting support component 77 and into the structure 56 for connection to a power source. In another embodiment the lighting bulb component 79 may include a solar powered or battery powered component where no wires are connected to a power source. However, the present invention is not limited to these embodiment and other embodiments can also be used to practice the invention.

In one embodiment, components of structure 56 including the pultruded structure 52 (including lighting component 77 of FIG. 7) are produced with an overwrapping transverse winding process that combines continuous filament winding with a pultrusion manufacturing process to produce a pultruded pullwound hollow cylindrical structure with the shape of hollow cylindrical structure 50 that is used for components in structure 56.

Figure 8:
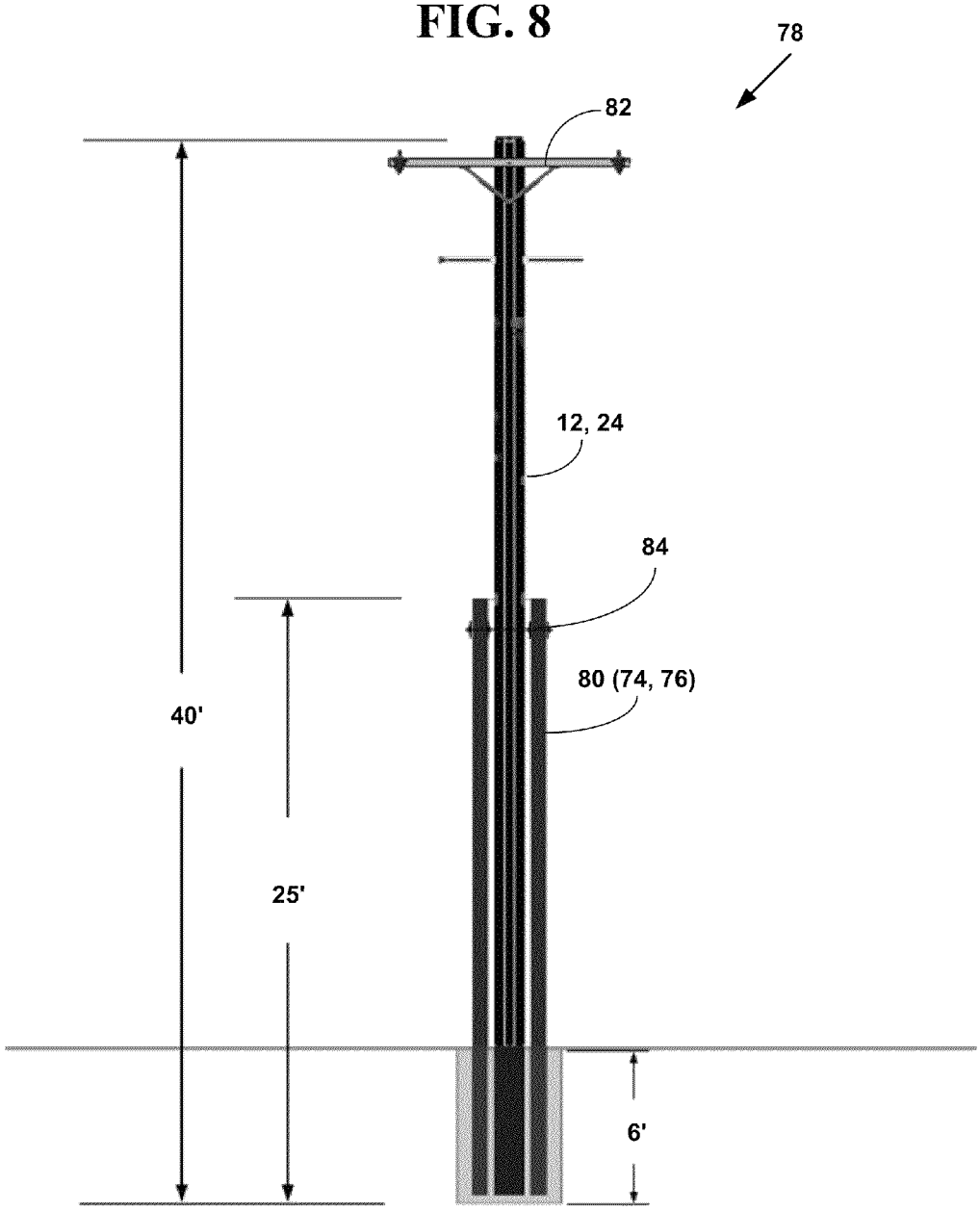
FIG. 8 is a block diagram illustrating a side view of an exemplary transmission structure support component.

FIG. 8 is a block diagram 78 illustrating a side view of an exemplary transmission structure support component 80. The transmission structure support component 80 is illustrated with a single transmission pole 82. The single transmission pole 82 includes extruded and/or pultruded poles 10, 50. FIG. 8 illustrates the transmission structure support component 80 secured in 6 feet concrete and a total length of 25 feet. The exemplary transmission pole 82 is illustrated as 40 feet in length. However, the present invention is not limited to these lengths and measurements and other lengths measurements can also be used to practice the invention.

FIG. 8 illustrates the single transmission pole 82 through bolted 84 into the exemplary transmission structure support component 80. However, the present invention is not limited to such an attachment method and other attachment methods can also be used to practice the invention.

In one embodiment, the transmission structure support component 80 is used as the third leg component 72 and the fourth leg component 74 in the structure 56. However, the present invention is not limited to this embodiment and other embodiments may also be used to practice the invention.

Figure 9:
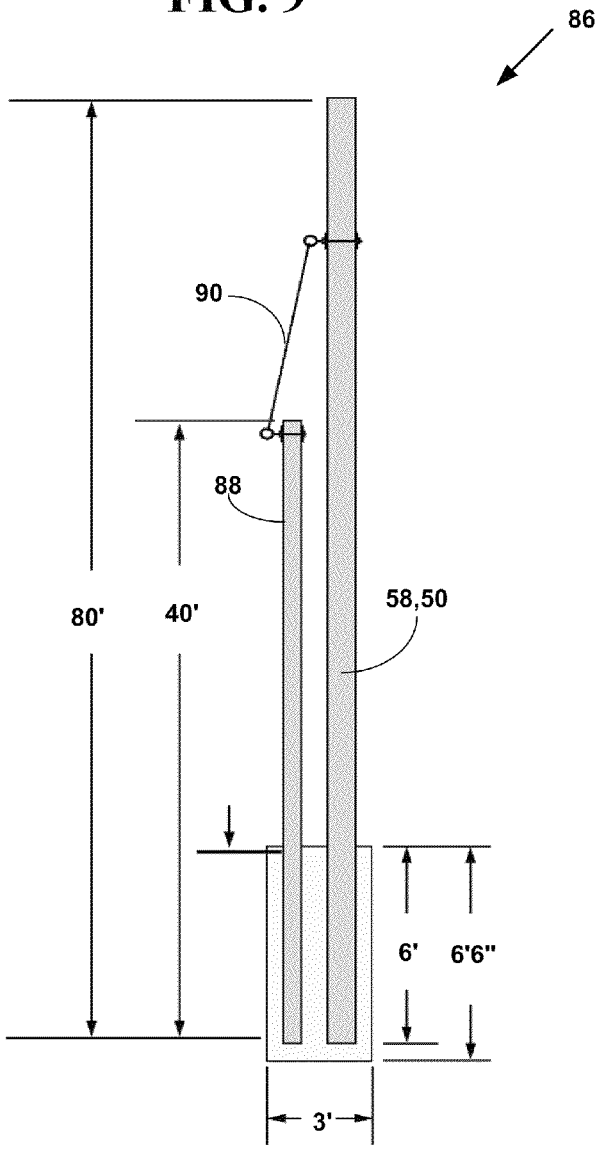
FIG. 9 is a block diagram illustrating an additional support component for the exemplary transmission support structure.

FIG. 9 is a block diagram 86 illustrating an additional support component 88 for the exemplary transmission support structure 56. The additional support component 88 may be used with first leg component 58 and/or second leg component 60 to provide additional support. The additional support component 88 provides additional lateral and medial support to the utility line support structure 56.

In one embodiment, the additional support component 88 is connected with a cable 90 via two eye bolts that are through bolted 84 through the legs 58, 60 and the additional support component 88. The cable can be metal, a composite material or other materials. However, the present invention is not limited to this embodiment and other types of attachments can also be used to practice the invention.

In one embodiment, the additional support component 88 includes extruded and pultruded hollow cylindrical structures 10, 50. However, the present invention is not limited to this embodiment and types of structures in other size and shapes can also be used for the additional support component 88 (e.g., metal, wood, composite material, etc.).

In one embodiment, the additional support component 88 and the legs 58, 60 are placed 3 feet apart in an earth surface and embedded into concrete to a depth of 6 feet and/or 6 feet 6 inches to provide additional support. However, the present invention is not limited to this embodiment and other types of materials and embedding depths can also be used to practice the invention.

In one embodiment, the additional support component 88 can also be placed next to a single transmission pole 82. In another embodiment, the additional support component 88 is used to allow a the structure 56 or the single transmission pole 82 to be used as dead-end on a transmission line sequence. Dead-end towers have other differences from suspension towers as they are built stronger, they often have a wider base, and they often have stronger insulator strings to withstand the forces associated with the an end of transmission line sequence.

Figure 10:
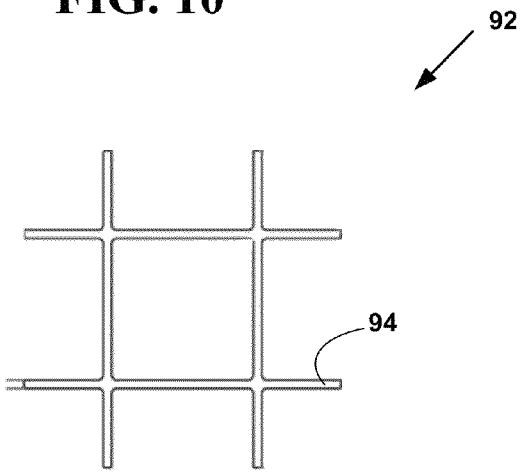
FIG. 10 is a block diagram illustrating an internal support component for an exemplary structural, lighting, distribution or transmission support structure.

FIG. 10 is a block diagram 92 illustrating an internal support component 94 for an exemplary distribution or transmission support structure 56. In one embodiment, the internal support structure comprises the composite or plastic material including re-enforcing fibers as was described above for the extruded and/or pultruded components. In another embodiment, the integral support structure is made from a different material than the extruded and/or pultruded components. In one embodiment, the internal support component 94 (i.e., integral and/or removable) also includes integral copper wires, other metal wires so the internal support component can act as an antenna or be used for a lighting structure.

Figure 11:
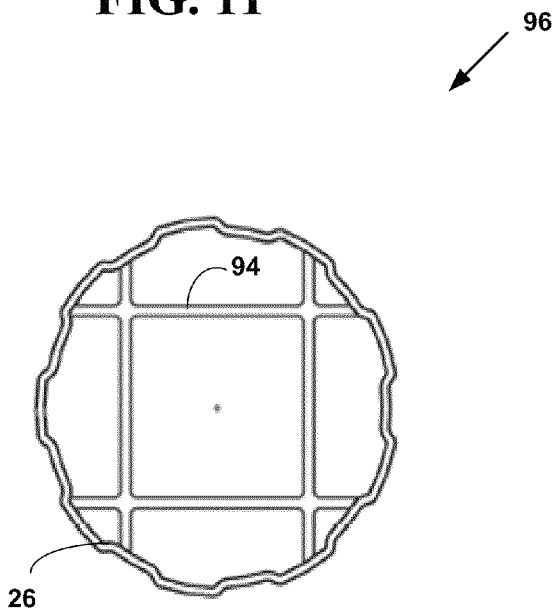
FIG. 11 is a block diagram illustrating an internal support component for an exemplary structural, distribution transmission support structure within pultruded hollow cylindrical cylinder.

FIG. 11 is a block diagram 96 illustrating an internal support component 94 for an exemplary transmission support structure within pultruded hollow cylindrical cylinder 50.

FIG. 11 illustrates the internal support component 94 within pultruded hollow cylindrical cylinder 50 with structure 26. However, the same internal support component 94 is also used within pultruded or extruded hollow cylindrical cylinder 10 with structure 15 in a similar manner.

The internal support structure 94 provides additional lateral support (i.e., support for sideways movement) and medial (i.e., support for middle movement) support for the transmission structure 56.

In one embodiment, the internal support structure 94 is manufactured as an integral component of the extruded and pultruded hollow cylindrical structures 10, 52. In another embodiment, the internal support structure is a separate removable component that is physically inserted into the extruded and pultruded hollow cylindrical structures 10, 52.

In addition to support, the internal support structure 94 also provides plural separate channels in which wires and/or cables can be placed inside the extruded and pultruded hollow cylindrical structures 14, 24. This prevents exposure of the wires and cables to the weather and makes the structure 56 more aesthetically appealing when viewed. In addition, the separate channels also provide insulation and help prevent electromagnetic interferences from electrical and magnetic currents generated by the wires and/or cables being used inside the hollow cylindrical cylinders. Otherwise, electrical and magnetic currents generated by such wires and/or cables cause electrical and magnetic disturbances that may interrupt, obstruct, or otherwise degrade or limit the effective performance of an electrical circuit.

The internal support structure 94 also provides plural separate channels in which wires and/or cables can be placed inside the extruded and pultruded hollow cylindrical structures 14, 24 wherein the structures are used for lighting structure components 77.

In one embodiment, the structure 56 includes both external electric distribution or transmission components for transmitted electricity and internal antenna components for telecommunications.

Figure 12:
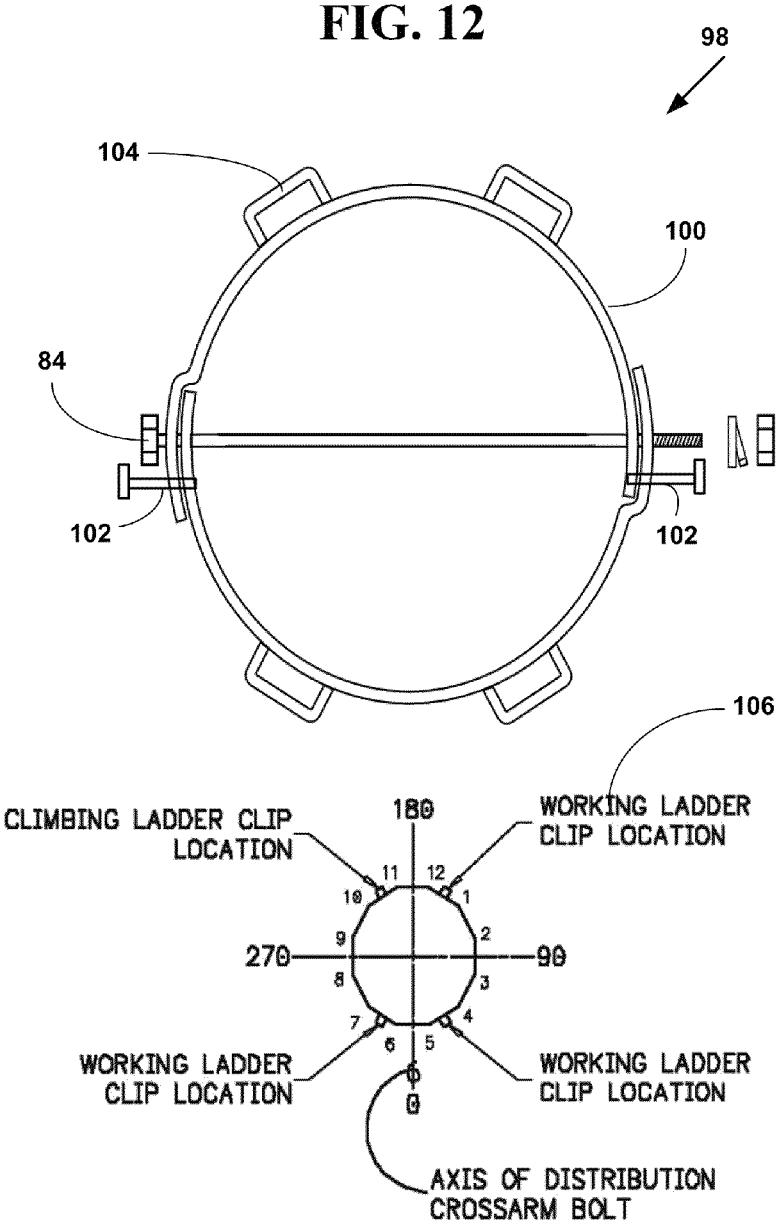
FIG. 12 is block diagram illustrating an attachable/detachable climbing component used on the exemplary utility line support structure.

FIG. 12 is block diagram 98 illustrating an attachable/detachable climbing component 100 used on the exemplary utility line support structure 56. In the normal course of business, it is often necessary to allow maintenance workers to climb the extruded and pultruded hollow cylindrical structures 10, 52 that make up the utility line support structure 56.

However, due to the shape of the cylinders and the material they are made of, conventional methods of free-climbing and/or climbing with lineman's spikes cannot be used. As a result, in one embodiment, the utility line support structure 56 includes an attachable/detachable climbing component 100 that is used to climb on the structure.

Plural attachable/detachable climbing components 100 are used to create a base for a climbing ladder components and/or for inserting climbing pegs. In one embodiment, the attachable/detachable climbing component 100 comprises metal, plastic, rubber, wood, composite materials, or other materials.

In one embodiment, the attachable/detachable climbing component 100 is through bolted 84 through pre-drilled holes in the structure 56. In another embodiment, the attachable/detachable climbing component 100 is attached externally to the structure 56 without through bolting 84 and without using any pre-drilled holes and includes another type of tightening bolt 102 that is used to pressure tighten the attachable/detachable climbing component 100 to the structure 56. Only two tightening bolts 102 are illustrated in FIG. 12. However, more or fewer tightening bolts may also be used to practice the invention.

The attachable/detachable climbing component 100 includes plural climbing receptacles 104 that engage climbing components such as climbing pegs, climbing ladder components, etc. FIG. 12 also includes an exemplary attachment pattern 106 for attaching a climbing ladder typically used for distribution and transmission poles and/or legs of transmission towers. However, the present invention is not limited to such an attachment pattern 106 and other attachment patterns can also be used to practice the invention.

Figure 13:
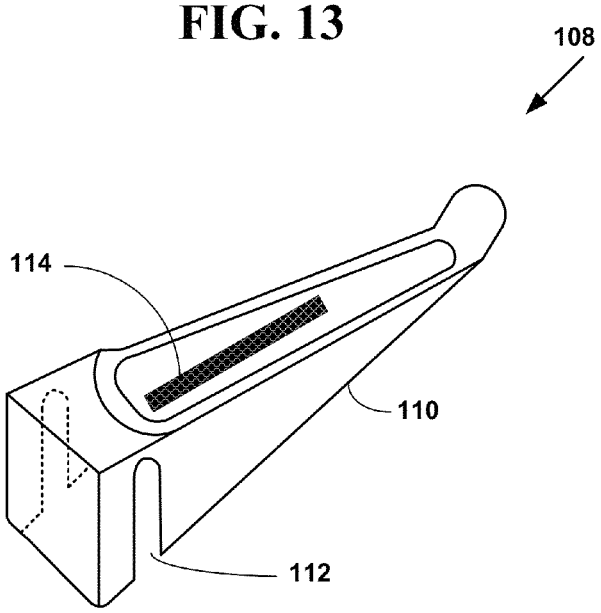
FIG. 13 is a block diagram illustrating an exemplary attachable/detachable climbing rung.

FIG. 13 is a block diagram 108 illustrating an exemplary attachable/detachable climbing rung 110.

In FIG. 13, the climbing rung 110 includes a foot/hand peg with a primary attachment component 112. The foot/hand peg 110 allows a maintenance worker and/or technician to climb the pultruded/extruded structures 10, 52 and/or structure 56 by creating a temporary, removable ladder and/or climbing structure.

In one embodiment, the foot/hand peg 110 includes a metal, composite material, rubber, plastic, pultruded materials, extruded materials or other materials foot/hand peg. In one exemplary embodiment, the foot/hand peg 110 includes a steel foot/hand peg 110. However, the present invention is not limited to these embodiments and other embodiments can also be used to practice the invention.

The foot/hand peg 110 slides directly into one of the plural climbing receptacles 104 (FIG. 12) and engages the climbing receptacle 104 via the secondary attachment component 148. This securely anchors the foot/hand peg 110 in the climbing receptacle 104.

In one embodiment, a portion 114 of an upper surface of the foot/hand peg 110 includes a non-slip component 116 (not drawn to scale and not illustrated as covering the whole upper surface). In another embodiment, the whole upper surface of the foot/hand peg includes a non-slip component 116.

In one embodiment, the non-slip component 116 includes a slip resistant epoxy coating comprising Tetraethylenepentamine, and/or Epichlophydrin and Bisphenol A and Alkyl Glycidyl Ether, with or without Silicon Dioxide (i.e., sand).

In another embodiment, the non-slip component 116 includes a silicon carbide-coated aluminum non-slip strip.

In another embodiment, the non-slip component 116 includes a pultruded composite component cover placed over the foot/hand peg 110.

In another embodiment, the non-slip component 116 includes an aromatic polyurethane and/or an aliphatic polyurethane coating.

In another embodiment, the foot/hand peg 110 includes an upper surface completely coated with a non-slip component 114 including, but not limited to, rubber, silicon, plastic, composite material or other non-slip material.

However, the present invention is not limited to such embodiments and other materials, coverings, coatings and embodiments can be used to practice the invention.

The components of structure 56 allow distribution poles and transmission towers with or without lighting components to be designed easier, manufactured cheaper, installed easier and quicker and maintained easier than those made of other material such as steel, other metals, wood, etc.

All of the measurements, lengths and dimensions described herein are exemplary only and many other measurements, lengths and dimensions can be used to produce the components described herein and to practice the invention.

It should be understood that the processes, methods and system described herein are not related or limited to any particular type of component unless indicated otherwise. Various combinations of general purpose, specialized or equivalent components combinations thereof may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more or fewer or equivalent elements may be used in the block diagrams.

The claims should not be read as limited to the elements described unless stated to that effect. In addition, use of the term "means" in any claim is intended to invoke 35 U.S.C. §112, paragraph 6, and any claim without the word "means" is not so intended.

Therefore, all embodiments that come within the scope and spirit of the following claims and equivalents thereto are claimed as the invention.

I claim:

1. A utility line support structure, comprising in combination:

a first leg component and a second leg component each comprising a hollow cylindrical structure, wherein the hollow cylindrical structure includes:

an external surface including a plurality of protruding components connected to a plurality of intruding components, wherein each protruding component includes two curved components for connecting the protruding component to two intruding components, an internal surface including a plurality of intruding components connected to the plurality of protruding components, wherein each intruding component includes two curved components to connect the intruding component to two protruding components, wherein the curved components includes a pre-determined radius with two outer radius portions on a protruding component and two inner radius portions on an intruding component, wherein the hollow cylindrical structure further include a pre-determined inner radius from a center point to an inner portion of the internal surface and includes a pre-determined outer radius from the center point to an outer portion the extruded surface, wherein the difference between the pre-determined inner radius and the pre-determined outer radius determines a thickness of the hollow cylindrical structure, wherein the hollow cylindrical structure further includes a pre-determined length, wherein the hollow cylindrical structure further includes a plurality of longitudinal reinforcement fibers with a plurality of helical-wound layers obtained via an overwrapping transverse winding process used during a manufacturing process used to create the hollow cylindrical structure, and wherein the hollow cylindrical structure further comprises a plastic or composite material with reinforcing fibers thereby providing additional lateral and medial strength for the utility line support structure;

the utility line support structure further comprising a first cross-brace component connected at a first end to the first leg component and at a second end to the second leg component wherein the first end and the second end of the first cross-brace are connected at a pre-determined angle between the first leg component and the second leg component, and wherein the first cross-brace includes the hollow cylindrical structure at a second pre-determined length;

a second cross-brace component connected at a first end to the first leg component and at a second end to the second leg component, wherein the first end and the second end of the second cross-brace are connected at a pre-determined angle between the first leg component and the second leg component, and wherein the second cross-brace includes the hollow cylindrical structure at the second pre-determined length; and a cross arm component connected horizontally across the first leg component and the second leg component at a first attachment point to the first leg component and a second attachment point to the second leg component, wherein the cross arm component provides support for electric transmission components, electric sub-transmission components, electric distribution lines and support for other loads including cables or wires, wherein the cross arm component horizontally extends past the first leg component and the second leg component a pre-determined distance, and wherein the cross arm component includes the hollow cylindrical structure at a third pre-determined length.

2. The utility line support structure of claim 1 wherein the hollow cylindrical structure is a pultruded hollow cylindrical structure.

3. The utility line support structure of claim 1 wherein the hollow cylindrical structure is an extruded hollow cylindrical structure.

4. The utility line support structure of claim 1 further comprising:

the hollow cylindrical structure including an integral internal support component, wherein the internal support component provides additional lateral and medial strength for the hollow cylindrical structure and wherein the internal support component provides a plurality of separate internal compartments wherein a plurality of cables or wires can be placed in an interior portion of the hollow cylindrical structure.

5. The utility line support structure of claim 1 further comprising:

a removable internal support component placed in the hollow cylindrical structures, wherein the internal support component provides additional lateral and medial strength for the hollow cylindrical structures and wherein the internal support component provides a plurality of separate internal compartments wherein a plurality of cables or wires can be placed in an interior portion of the hollow cylindrical structure.

6. The utility line support structure of claim 1 further comprising the hollow cylindrical structure including an internal support component, wherein the internal support component provides additional lateral and medial strength for the hollow cylindrical structure, wherein the internal support component provides a plurality of separate internal compartments wherein a plurality of cables or wires can be placed in an interior portion of the hollow cylindrical structure and wherein the internal support component includes integral metal wires that allow the internal support structure to be used an antenna for wireless or other types of communications and for lighting structures.

7. The utility line support structure of claim 1 wherein the hollow cylindrical structure includes integral metal wires that allow the structure to be used as an antenna for wireless or other types of communications and for lighting structures.

8. The utility line support structure of claim 1 wherein the hollow cylindrical structure is created with a liquid resin mixture and reinforcing fibers.

9. The utility line support structure of claim 8 wherein liquid resin mixture includes abisphenol-a epichlorohydrin-based vinyl ester resins or polyesters resins including isophthalic, orthophthalic, or propylene-maleate resins.

10. The utility line support structure of claim 8 wherein the hollow cylindrical structure includes a plurality of longitudinal reinforcement fibers with a plurality of helical-wound layers created with an overwrapping transverse winding process that combines continuous filament winding with a pultrusion manufacturing process to produce a pultruded pull-wound hollow cylindrical structure.

11. The utility line support structure of claim 1 wherein the plurality of intruding components are used as a plurality of channels to hold a plurality of different sets of wires such as communications wires or antenna wires.

12. The utility line support structure of claim 1 further comprising:

a third leg component and a fourth leg component each comprising the hollow cylindrical structure at a fourth pre-determined length, wherein an inner diameter and an outer diameter used for the hollow cylindrical structure for the third leg component and the fourth leg component is larger than an inner diameter and an outer diameter used for hollow cylindrical structure used for the first leg component and the second leg component, wherein a thickness of the hollow cylindrical structure for the third leg component and the fourth leg component is greater than the thickness of the hollow cylindrical component used for the first leg component and the second leg component, wherein the third leg component and the fourth leg component are securely embedded into an earth surface including the utility line support structure, wherein the first leg component is placed with the third leg component and the second leg component is placed in the fourth leg component, thereby providing additional lateral and medial strength for the utility line support structure, and wherein a shape for the hollow cylindrical structure for the first leg component inter-locks with a shape for the hollow cylindrical structure for the third leg component and a shape for the hollow cylindrical structure for the second leg component inter-locks the hollow cylindrical structure for the fourth leg component thereby providing additional lateral and medial strength for the utility line support structure.

13. The utility line support structure of claim 1 wherein the hollow cylindrical structure includes a pre-determined color.

14. The utility line support structure of claim 1 wherein each of the hollow cylindrical structures is a same pre-determined color, or wherein selected ones of the hollow cylindrical structures are one of a plurality of different colors.

15. The utility line support structure of claim 1 further comprising:

an additional support component placed in an earth surface in close proximity to the first leg component or the second leg component to provide additional support for the utility line support structure, wherein the additional support component is connected to the first leg component or the second leg component with one or more cables and wherein the additional support component provides additional lateral and medial support to the utility line support structure.

16. The utility line support structure of claim 1 further comprising:

an attachable/detachable climbing component with a plurality of attachment receptacles that engage a plurality of attachable/detachable climbing rungs, climbing pegs or climbing ladder components that allow the utility line support structure to be climbed.

17. The utility line support structure of claim 16 wherein the attachable/detachable climbing component is attached via pre-drilled holes in the first or second leg components via a through bolt or wherein the attachable/detachable climbing component is attached to the first or second leg components via pressure applied to the attachable/detachable climbing component via a pressure tightening bolt.

18. The utility line support structure of claim 16 wherein a plurality of attachable/detachable climbing components are attached to the first leg component or the second leg component in a pre-determined pattern to create a base for a climbing ladder components.

19. The utility line support structure of claim 1 further comprising:

a lighting support component, wherein the lighting support component includes a plurality of hollow cylindrical structures and wherein the plurality of hollow cylindrical structure includes a plurality of longitudinal reinforcement fibers with a plurality of helical-wound layers created with an overwrapping transverse winding process that combines continuous filament winding with a pultrusion manufacturing process to produce a pultruded pullwound hollow cylindrical structure.

* * * * *